US012167758B2

(12) United States Patent
Mazzarolo

(10) Patent No.: US 12,167,758 B2
(45) Date of Patent: Dec. 17, 2024

(54) WEARABLE AIRBAG DEVICE

(71) Applicant: ALPINESTARS RESEARCH S.P.A., Maser (IT)

(72) Inventor: Giovanni Mazzarolo, Coste di Maser (IT)

(73) Assignee: ALPINESTARS RESEARCH S.P.A, Maser (IT)

( * ) Notice: Subject to any disclaimer, the term of this patent is extended or adjusted under 35 U.S.C. 154(b) by 459 days.

(21) Appl. No.: 17/311,107

(22) PCT Filed: Dec. 4, 2019

(86) PCT No.: PCT/EP2019/083685
§ 371 (c)(1),
(2) Date: Jun. 4, 2021

(87) PCT Pub. No.: WO2020/115137
PCT Pub. Date: Jun. 11, 2020

(65) Prior Publication Data

US 2021/0360993 A1 Nov. 25, 2021

(30) Foreign Application Priority Data

Dec. 5, 2018 (IT) ..... 102018000010820

(51) Int. Cl.
*A41D 13/018* (2006.01)
*A41D 13/015* (2006.01)
*A41D 13/05* (2006.01)

(52) U.S. Cl.
CPC ..... *A41D 13/018* (2013.01); *A41D 13/0512* (2013.01); *A41D 13/0518* (2013.01); *A41D 13/0531* (2013.01); *A41D 13/0158* (2013.01)

(58) Field of Classification Search
CPC ..... A41D 13/0512; A41D 13/018; A41D 13/012; A41D 13/05; A41D 13/0518; A41D 13/0531; A61F 5/055; A61F 5/05816
See application file for complete search history.

(56) References Cited

U.S. PATENT DOCUMENTS 3,550,159 A * 12/1970 Eugenio ..... A41D 13/0155 2/463
3,866,241 A 2/1975 Grant
3,895,396 A * 7/1975 Amarantos ..... A41D 13/018 2/457

(Continued)

FOREIGN PATENT DOCUMENTS

CN 2225163 Y 4/1996
CN 201328382 Y 10/2009

(Continued)

OTHER PUBLICATIONS

PCT International Search Report and Written Opinion dated Jan. 15, 2020 for Intl. App. No. PCT/EP2019/083685, from which the instant application is based, 10 pgs.

*Primary Examiner* — Katherine M Moran
(74) *Attorney, Agent, or Firm* — Fredrikson & Byron, P.A.

(57) ABSTRACT

A wearable airbag device having at least one inflatable bag including a first side and a second side defining a gas inflatable volume therebetween. The at least one inflatable bag includes a plurality of airflow passages defined between said first side and second side.

23 Claims, 4 Drawing Sheets

(56) References Cited

U.S. PATENT DOCUMENTS

| | | | | |
|---|---|---|---|---|
| 4,242,769 | A * | 1/1981 | Rayfield | A41D 13/018 441/103 |
| 4,370,754 | A | 2/1983 | Donzis | |
| 9,126,065 | B2 * | 9/2015 | Uchida | A41D 13/018 |
| 9,265,643 | B2 * | 2/2016 | Britt | A61F 5/05816 |
| 9,439,459 | B2 * | 9/2016 | Placanica | A41D 13/0007 |
| 2004/0111790 | A1 | 6/2004 | Dainese | |
| 2004/0244100 | A1 | 12/2004 | Haddacks | |
| 2006/0175810 | A1 | 8/2006 | Goto | |
| 2012/0246788 | A1 | 10/2012 | Harrell et al. | |
| 2014/0331397 | A1 * | 11/2014 | Kasahara | A41D 13/0155 2/468 |
| 2023/0135854 | A1 * | 5/2023 | Wagner | A41D 13/0512 2/468 |

FOREIGN PATENT DOCUMENTS

| | | | |
|---|---|---|---|
| CN | 101822433 | A | 9/2010 |
| CN | 107752165 | A | 3/2018 |
| JP | 3059127 | U | 7/1999 |
| JP | 2004508235 | A | 3/2004 |
| JP | 2006218971 | A | 8/2006 |
| JP | 2012130663 | A | 7/2012 |
| KR | 100941945 | B1 | 2/2010 |
| WO | 2010073921 | A1 | 7/2010 |
| WO | 2015181734 | A1 | 12/2015 |

* cited by examiner

WEARABLE AIRBAG DEVICE

RELATED APPLICATIONS

This application is a 35 U.S.C. 371 national stage filing from International Application No. PCT/EP2019/083685, filed Dec. 4, 2019, which claims priority to Italian Application No. 102018000010820, filed Dec. 5, 2018, the teachings of which are incorporated herein by reference.

FIELD OF THE INVENTION

The present invention relates, in general, to the technical field of wearable airbag devices, i.e. airbag devices that can be worn to protect users from impacts and/or falls. In particular, the present invention relates to a wearable airbag device configured to improve airflow through the airbag device.

BACKGROUND

Wearable airbag devices have been developed to protect users from injuries caused by impacts against obstacles during different kind of activities, such as motorcycle riding, walking, industrial working activities and so on.

In the continuation of the present description reference will be made to a wearable airbag device suitable for being worn by a motorcyclist.

Typically, a wearable airbag device comprises an inflatable bag which, during normal use of the wearable airbag device, is arranged in a deflated state, or rest configuration, inside a casing configured to be worn by the motorcyclist.

In case the airbag is integrated in a protective garment, the casing can be defined, for example, between the outer layer of the protective garment, made of an abrasion resistant material, like leather, and the inner lining of the garment. Alternatively the casing can be defined between two thin layers, not necessarily made of an abrasion resistant material, of an undergarment designed to be coupled to an outer protective garment.

The casing has the function to keep in the correct position the inflatable bag and to provide the required support to the inflatable bag and to the other components of the wearable airbag device, which will be disclosed below.

The inflatable bag is intended to be activated only in the event of an emergency and, for this purpose, the inflatable bag is in fluid communication with at least one activation means, typically in the form of an inflation device, which is supported by the casing and is adapted to introduce into the inflatable bag a predefined quantity of an inflation fluid, like for example compressed gas, such as to inflate, and therefore expand, the inflatable bag.

The inflation of the inflatable bag is controlled by a mechanical or electronic system, also supported by the casing. For instance, the system for controlling the inflation of the inflatable bag consists of a control unit which constantly monitors the movements of the motorcyclist. More specifically, the control unit is able to compare at regular time intervals the data detected by suitable sensors, arranged for example on the casing of the wearable airbag device or on the motorcycle, with an algorithm which is pre-loaded inside it. If, on the basis of this algorithm, the data detected by the sensors indicate a loss of control of the motorcycle on which the motorcyclist is travelling or some other anomaly, the control unit transmits an activation command to the inflation device for inflating the inflatable bag. As a result, the inflatable bag passes from its rest configuration to an active or inflated configuration.

Usually, the inflatable bag is made of a woven fabric or membranes with low elasticity, due to the substantial force the airbag device must sustain from the inflating fluid during inflation. Moreover, due to the low elasticity, in the rest configuration, the inflatable bag has a shape quite similar to that of the body part that it must cover/protect once inflated.

At present, there are two main different techniques of producing an inflatable bag, i.e. sewed bag and woven bag.

According to the sewed variant, the inflatable bag is made by sewing together along their perimetric portions various layers, typically a lower layer and an upper layer.

According to the woven variant, the inflatable bag is made by means of a single weaving operation, using for instance a Jacquard loom which is able of creating airbags having different shapes and structures at the weaving stage, without needing any sewing operation. During the weaving operation by properly interlacing warp and weft threads the upper layer and the lower layer of the airbag are created. The perimetric connection between the layers is obtained by increasing the density of the threads, so as to obtain a single layer, for example a Panama weaving. Preferably, in order to reduce the permeability of the upper and lower layers, one or both layers can be coated with a polymeric film.

Such inflatable bags are known as "one-piece woven" (OPW) inflatable bags.

The inflatable bags often require the inclusion of some members which are provided to shape the inflatable bag into a desired dimension upon inflation. In particular, the inflatable bag often includes internal tethers to limit the volume of the inflatable bag once inflated. In particular, the tethers are designed to connect the upper and lower layers of the airbag so as to prevent the inflatable bag from "ballooning". Preferably, in the "sewed" airbag, the tethers are formed by threads fixed to the upper and lower layers. In the OPW airbag the tethers can be formed inside the airbag during the same weaving proceeding, being formed by the same warp and weft threads forming the upper and lower layers of the airbag.

The known wearable airbag devices present some drawbacks, mainly related to the inflatable bag.

In fact, since the inflatable bag is made of fabrics or membranes with low elasticity and has a shape covering all the body part that must be protected, it can be uncomfortable for the motorcyclist, because of the weight and the rigidity added to the wearable device.

Moreover, even if the airbag is inserted inside a casing made of a breathable fabric, unavoidably the structure of the airbag does not allow air to pass through, causing an overheating and a reduced perspiration of the user's body.

Moreover, in the sewed airbag the tethers are typically sewn into the inflatable bag manually. As a result, the incorporation of tethers into the inflatable bag tends to be not only labor intensive, but also requires a significant amount of time.

BRIEF SUMMARIES OF OBJECTS OF THE INVENTION

The main object of the present invention is therefore to provide a wearable airbag device configured to overcome or at least reduce the drawbacks above mentioned with reference to the known wearable airbag devices.

More specifically, the main object of the present invention is to provide a wearable airbag device configured to allow airflow there through, thereby improving breathability and comfort.

Another object of the present invention is to provide a wearable airbag device configured to allow the inflation of the inflatable bag to be controlled without the need of internal tethers. A further object of the present invention is to provide a wearable airbag device which can be manufactured at competitive costs.

The above mentioned objects, and other objects that will better appear in the following of the present description, are achieved by a wearable airbag device as defined in the attached independent claim 1. Preferred characteristics of the wearable airbag device are set forth in the dependent claims 2-20.

According to the invention, it is provided a wearable airbag device, which comprises at least one inflatable bag including a first side and a second side defining a gas inflatable volume therebetween.

The wearable airbag device is characterized in that the at least one inflatable bag comprises a plurality of airflow passages defined between the first side and the second side.

Due to the above combination of features, in particular due to the presence of the airflow passages defined in the inflatable bag(s), the wearable airbag device of the invention advantageously presents a higher breathability.

A further advantage of the wearable airbag device of the invention is that it provides a higher comfort to the user. In fact, thanks to the airflow passages the inflatable bag(s) can be more flexible.

BRIEF DESCRIPTIONS OF THE DRAWINGS

The above and other features and advantages of the present invention will become more clearly apparent from the following detailed description of preferred embodiments of a wearable airbag device, such description being provided merely by way of non-limiting example and being made with reference to the accompanying drawings. In the drawings.

DETAILED DESCRIPTION OF EMBODIMENTS OF THE INVENTION

Figure 1:
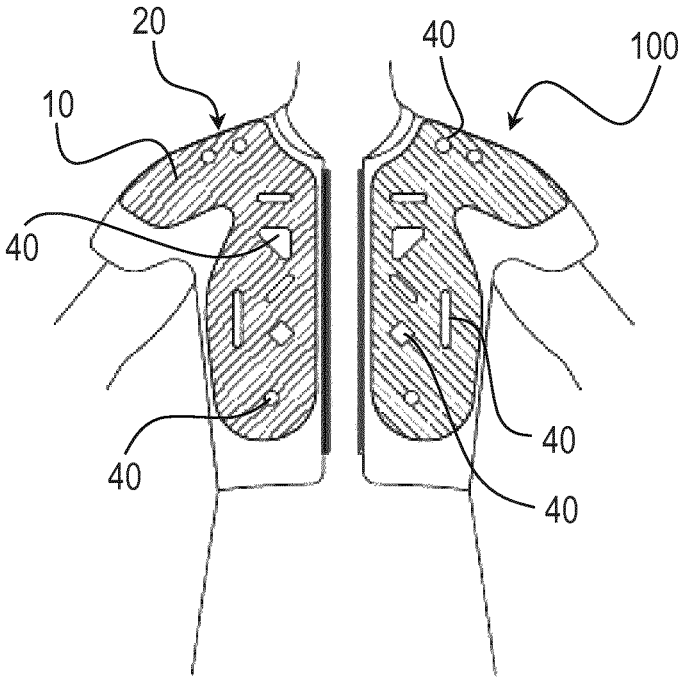
FIG. 1 shows, in schematic form, a front view of a wearable airbag device according to a first embodiment of the present invention, worn by a user.
Figure 2:
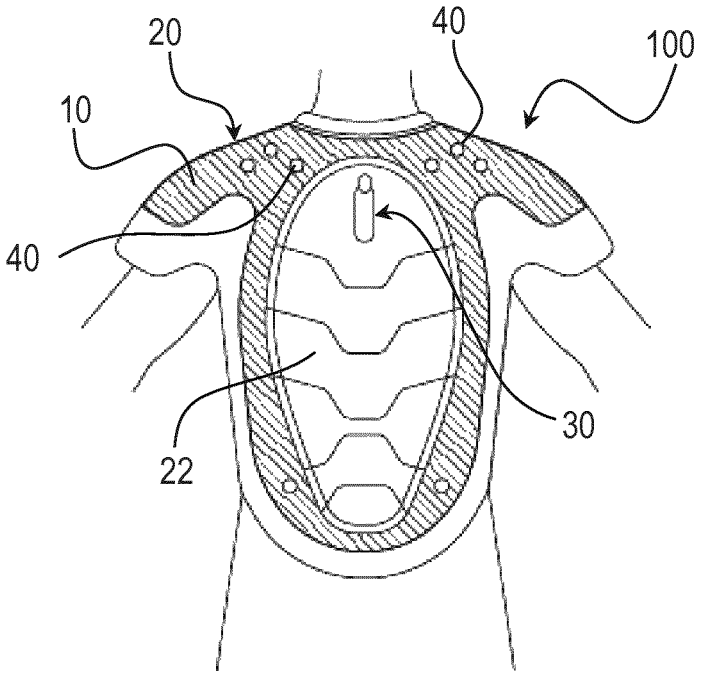
FIG. 2 shows, in schematic form, a back view of the wearable airbag device of FIG. 1.
Figure 3:
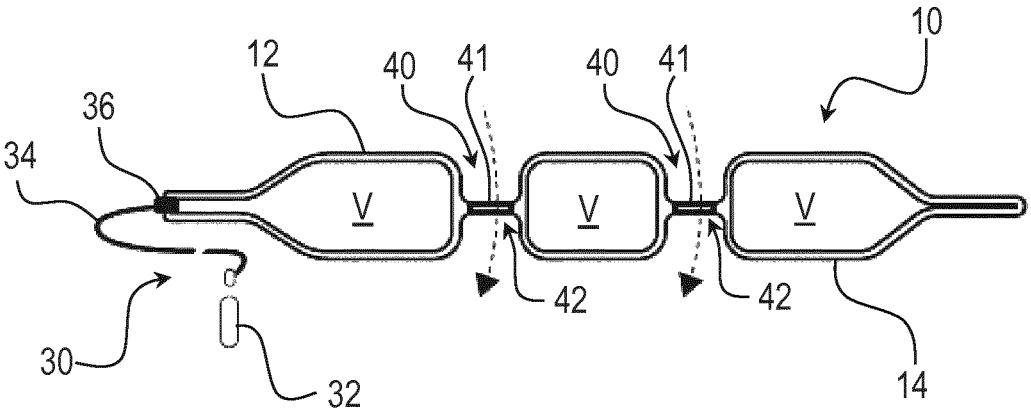
FIG. 3 shows, in schematic form, a cross-sectional view of an inflatable bag, in an active configuration, of the wearable airbag device of FIGS. 1 and 2.

With reference to FIGS. 1 to 3, a wearable airbag device provided in accordance with a first embodiment of the present invention is indicated, in general, with the reference numeral 100. The wearable airbag device 100 comprises an inflatable bag 10 configured to assume alternately a rest configuration, in which it is in a deflated state, and an active configuration, in which it is in an inflated state.

The wearable airbag device 100 can further comprise a casing 20 configured to be worn by a motorcyclist and to house the inflatable bag 10. The inflatable bag 10 is preferably designed to protect the shoulders, the chest and the back of the user.

According to alternative embodiments of the invention, not shown in the figures, the wearable airbag device may be provided with a plurality of inflatable bags, independent of each other, and each designed to be positioned within the casing 20 opposite to a portion of the body which is to be protected from impacts.

The casing 20 is preferably shaped to provide the required support to the one or more inflatable bags 10, as well as to other components of the wearable airbag device 100 described in detail below. The casing 20 can be made of breathable material, like for example leather or standard fabric. The casing 20 can also be made with mesh materials.

To carry out the inflation of the inflatable bag 10, in case of falls and/or impacts by a motorcyclist or a motorcycle in which he/she travels, the wearable airbag device 100 further comprises inflation means 30, supported by the casing 20. The inflation means 30 are in fluid communication with the inflatable bag 10 and are configured to introduce into the inflatable bag 10 a predetermined quantity of an inflation fluid.

In the embodiments shown in the figures, the inflation means 30 comprise, for example, a compressed gas cartridge 32, connected by a duct 34 to an on-off valve 36, fixed to the inflatable bag 10, which allows the introduction of the compressed gas in the inflatable bag 10.

In the embodiment shown, the compressed gas cartridge 32 is supported by a back protector 22 (see FIG. 2) coupled to the casing 20 of the wearable airbag device 100; however the compressed gas cartridge 32 can in alternative be included inside the casing 20 or in some cases inside the bag 10. Moreover, it is possible to provide more than one inflation means 30. The inflation means 30 can be electrically controlled by a control unit (not shown) which constantly monitors the movements of the motorcyclist.

More specifically, the control unit is able to compare at regular time intervals the data detected by suitable sensors (not shown), arranged for example on the casing 20 of the wearable airbag device 100 or on the motorcycle, with an algorithm pre-loaded inside it. If, on the basis of this algorithm, the data detected by the sensors indicate a loss of control of the motorcycle on which the motorcyclist is travelling or some other anomaly, the control unit transmits an activation command to the one or more inflation means 30 for inflating the inflatable bag 10. As a result, the inflatable bag 10 passes from its rest configuration to the active or inflated configuration thereof.

As an alternative, the inflation means 30 can be mechanically controlled by utilizing an activation cable connected to the motorcycle, which cable actuates the inflatable bag 10 following a separation of the motorcyclist by the motorcycle, typically caused by a fall and/or an impact.

As shown in detail in FIG. 3, the inflatable bag 10 comprises a first side 12 and a second side 14 joined to each other along the perimeter of the inflatable bag 10 so as to define a gas inflatable volume V.

As it is well-known, the first side 12 and the second side 14 of the inflatable bag 10 can be sewn together at their perimetric portions. In alternative, the inflatable bag can be made of a single weaving operation using, for instance, a Jacquard loom. As stated above, by means of Jacquard looms it is possible to obtain in one single weaving operation an inflatable bag formed by the first side and the second side which are perimetrically joined by a connecting portion.

Thus, the inflatable bag 10 comprises a perimetric connecting portion and a central body encircled by the perimetric connecting portion.

In the inflatable bag 10 a plurality of airflow passages 40 is formed to allow a flow of air to pass through the inflatable bag 10, as shown by arrows in FIG. 3, and thus through the wearable airbag device 100. In particular, the airflow passages 40 are defined between the first side 12 and the second side 14 of the inflatable bag 10.

In the embodiment of FIG. 3, each airflow passage 40 of the plurality of airflow passages is obtained by airtight sealing the first side 12 and the second side 14 of the inflatable bag 10 at predetermined areas within the inflatable bag 10, thereby obtaining a non-inflatable area 42, and then forming at least one aperture 41 in said non-inflatable area 42.

The non-inflatable areas 42 are perimetrically closed and are positioned within the inflatable bag 10, in particular in its central body.

The non-inflatable area 42, also called "zero height" area, can be obtained, in the sewed airbags, by fixing an internal portion of the first side 12 to a corresponding internal portion of the second side 14, for example by means of a stitching. In this case, the aperture 41 can be obtained by piercing the non-inflatable area.

In the OPW airbag, the non-inflatable area 42 can be obtained during the weaving process by sealing the first side 12 and the second side 14 at the internal desired areas. In this case, the aperture 41 is thus obtaining during the weaving process.

Each airflow passage 40 defines a non-inflatable portion of the bag, not including a first and a second side.

The airflow passages 40 formed in the inflatable bag 10 can have different shapes, for example a circular, triangular, square or rectangular shape. Moreover, the non-inflatable area 42 can be provided with one aperture 41 having advantageously the same shape as the passage 40. In alternative, the non-inflatable area 42 can be provided with a plurality of apertures 41 having different shapes. In this case, each passage 40 will be formed by said plurality of apertures 41 distributed onto the non-inflatable area 42.

The airflow passages 40 can be suitably distributed within the inflatable bag 10, for example at the area corresponding to the back, the shoulders and/or the chest of the user. Preferably, the airflow passages 40 are provided at the area of the airbag covering the back and the chest. By suitably shaping and distributing the airflow passages 40 within the inflatable bag 10, it is possible not only to improve the breathability and comfort of the wearable airbag device, but it is also possible to provide areas having a differentiated inflation.

As a matter of fact, the provision of non-inflatable area 42 within the airbag prevents the inflatable bag 10 from ballooning in said areas wherein the airflow passages 40 are provided. In this way, it is possible to avoid the use of internal tethers, simplifying the manufacturing process of the airbag.

Figure 4:
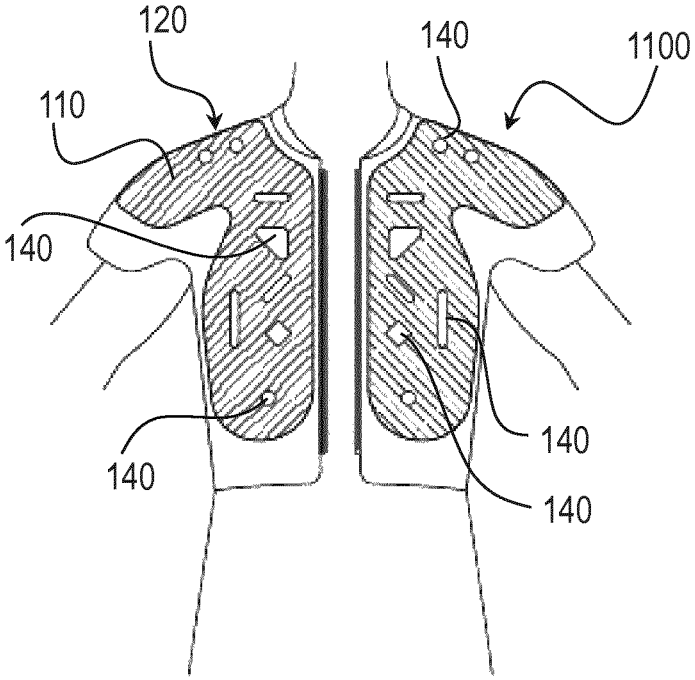
FIG. 4 shows, in schematic form, a front view of a wearable airbag device according to a second embodiment of the present invention, worn by a user.
Figure 5:
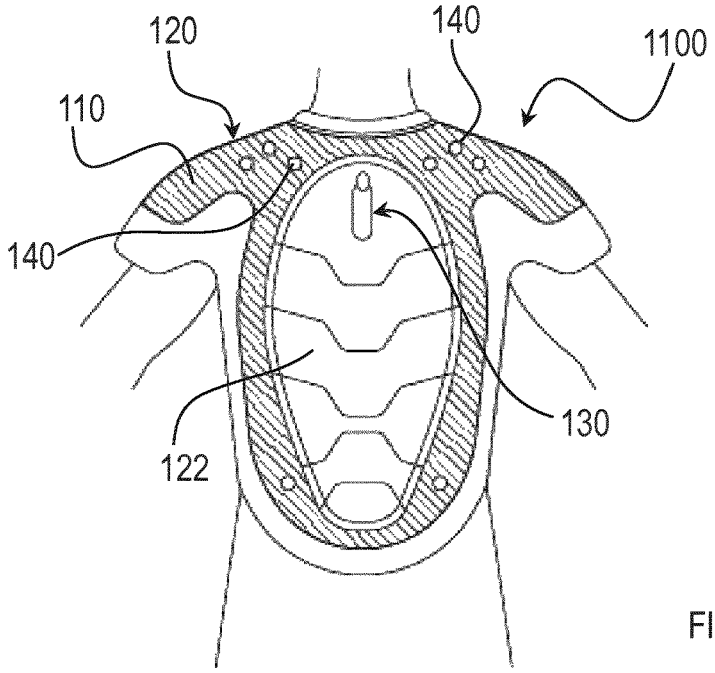
FIG. 5 shows, in schematic form, a back view of the wearable airbag device of FIG. 4.
Figure 6:
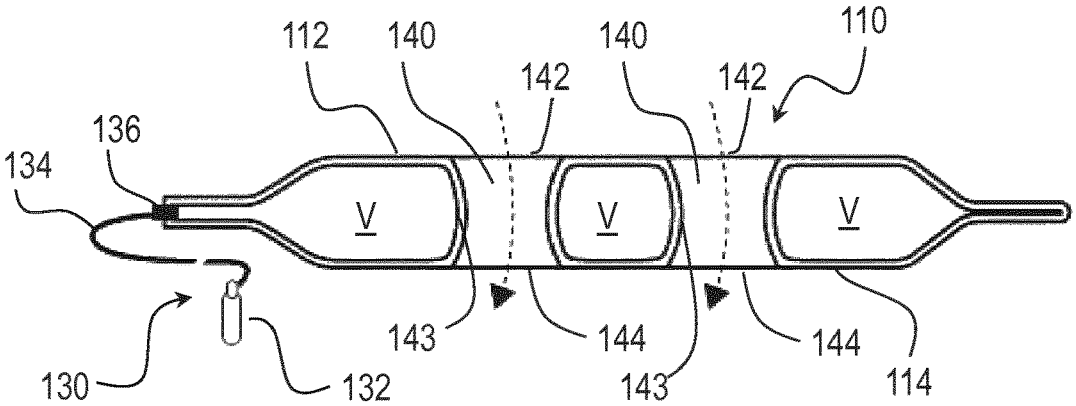
FIG. 6 shows, in schematic form, a cross-sectional view of an inflatable bag, in an active configuration, of the wearable airbag device of FIGS. 4 and 5.

With reference to FIGS. 4 to 6, a wearable airbag device provided in accordance with a second embodiment of the present invention is indicated, in general, with the reference numeral 1100.

The wearable airbag device 1100 substantially corresponds to that described above in connection with FIGS. 1 to 3, and therefore comprises a casing 120 configured to be worn by a motorcyclist and to house and support an inflatable bag 110 and inflation means 130 in fluid communication with the inflatable bag 110 for introducing the compressed gas in the inflatable bag 110. The casing 120 can be made of breathable material, like for example leather or standard fabric. The casing 120 can also be made with mesh materials.

As shown in detail in FIG. 6, the inflation means 130 comprise, for example, a compressed gas cartridge 132 connected by a duct 134 to an on-off valve 136. The compressed gas cartridge 132 can be supported by a back protector 122 coupled to the casing 120 or can be included inside the inflatable bag 110.

The wearable airbag device 1100 differs from the wearable airbag device 100 of FIGS. 1-3 for the different configuration of the inflatable bag(s).

In particular, the inflatable bag 110 of the wearable airbag device 1100 comprises a first side 112 and a second side 114 connected along the perimeter of the inflatable bag 110 so as to define a gas inflatable volume V. The first side 112 and the second side 114 of the inflatable bag 110 can be sewn together.

Figure 7:
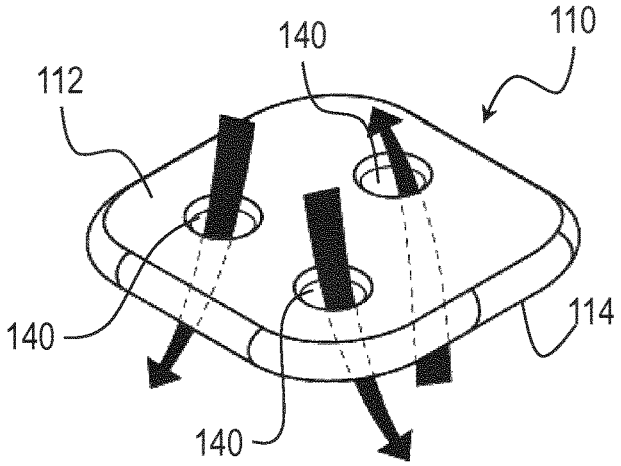
FIG. 7 shows, in schematic form, a perspective view of a portion of the inflatable bag of FIG. 6, with arrows indicating the flow of air through the airflow passages.

In the inflatable bag 110 a plurality of airflow passages 140 is formed between the first side 112 and the second side 114 to allow a flow of air to pass through the inflatable bag 110, as shown by arrows in FIGS. 6 and 7, and thus through the wearable airbag device 1100.

Each airflow passage 140 is obtained by connecting by means of internal partitions 143 cut-out portions 142, 144 provided respectively in the first and second sides 112, 114. Preferably the internal partitions 143 are connected to first and second sides 112, 114 in an air-tight manner by means of thermo-welding.

As shown in FIGS. 6 and 7, when the airbag is inflated each passage 140 is delimited by the internal partition 143 extending between the first side 112 and the second side 114 of the inflatable bag 110.

Such an embodiment is particularly effective in case it is requested that the airbag offers a uniform protection all over the part of the body to be protected. As a matter of fact, in this case the provision of passages 140 improves the breathability and the comfort of the airbag and at the same it allows to have, thanks to the internal partitions 143, an airbag uniformly inflated. Obviously, the internal partitions 143 can be made with different lengths.

Figure 8:
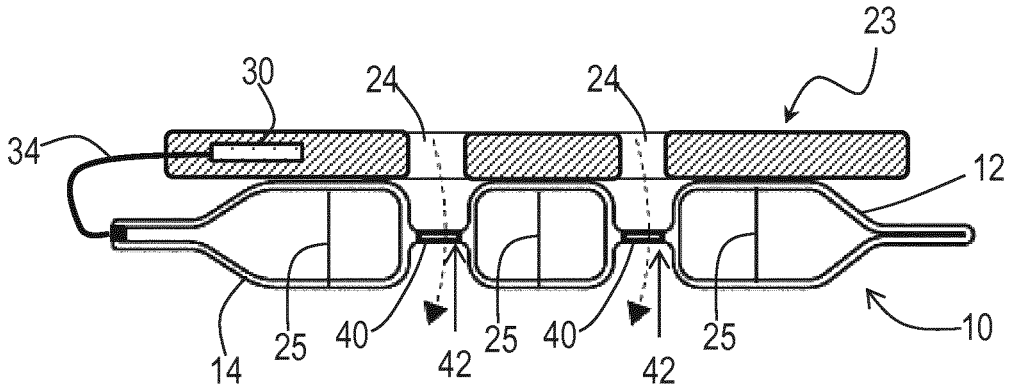
FIG. 8 is a figure similar to FIG. 3, wherein the inflatable bag is coupled to a protector.
Figure 9:
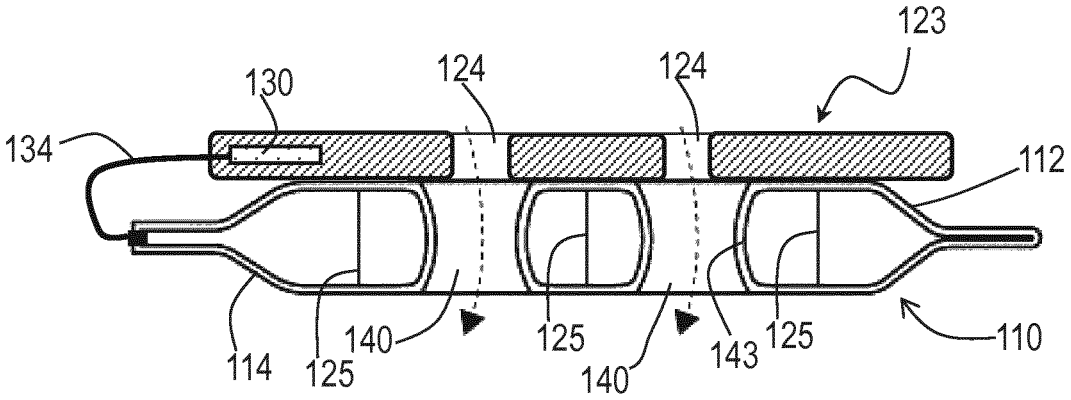
FIG. 9 is a figure similar to FIG. 6, wherein the inflatable bag is coupled to a protector.

Advantageously, as shown in FIGS. 8 and 9, the inflatable bag 10, 110 can be at least partially coupled to a protector 23, 123 which is preferably designed to be positioned on the outer side 12, 112 of the inflatable bag 10, 110. Preferably, the protector 23, 123 is made of a semi-rigid material.

Advantageously, the protector 23, 123 is suitable for spreading impact forces acting on the inflatable bag 10, 110 and for compensating any weakness the inflatable bag 10, 100 may have due to the presence of the airflow passages 40, 140.

Preferably, in order to improve the breathability of the wearable airbag device 100, 1100 also the protector 23, 123 can be provided with a plurality of through holes 24, 124. Such holes 24, 124 are preferably designed to be at least partially superimposed over the airflow passages 40, 140 provided in the inflatable bag 10, 110. In this way a flow of air can pass through the inflatable bag and the protector.

In a preferred embodiment the protector 23, 123 is a back protector. Advantageously, the inflation means 30, 130 are connected to the protector 23, 123. Preferably, the inflation means 30, 130 are housed inside the protector 23, 123.

Moreover, even if the presence of the non-inflatable areas 42 or of the internal partitions 143 is effective for limiting the expansion of the inflatable bag 10, 110, the latter can also be provided with internal tethers 25, 125. The tethers 25, 125 cooperate with the non-inflatable areas 42 or the internal partitions 143 to obtain a uniform thickness of the bag 10, 110 when it is in the operating condition.

The person skilled in the art, in order to satisfy specific requirements, may make modifications to the embodiments of the wearable airbag device described above and/or replace parts described with equivalent parts, without departing from the scope of the attached claims.

The invention claimed is:

1. A wearable airbag device comprising at least one inflatable bag including a first side and a second side defining a gas inflatable volume therebetween, characterized in that said at least one inflatable bag comprises a plurality of airflow passages defined between said first side and second side, each airflow passage being provided in a non-inflatable area of the inflatable bag;

wherein at least one aperture is formed in said non-inflatable area; and wherein said non-inflatable area is defined by connecting an internal portion of the first side to a corresponding internal portion of the second side.

2. The wearable airbag device according to claim 1, wherein said non-inflatable area is perimetrically closed and positioned within the inflatable bag.

3. The wearable airbag device according to claim 1, wherein said non-inflatable area is provided with one aperture.

4. The wearable airbag device according to claim 1, wherein the passages are circular, triangular, square or rectangular shaped.

5. The wearable airbag device according to claim 1, further comprising inflation means in fluid communication with said at least one inflatable bag;

said inflation means being configured to introduce into the at least one inflatable bag a predetermined quantity of an inflation fluid.

6. The wearable airbag device according to claim 1, further comprising a casing made of breathable material configured to be worn by a user and to house and support said at least one inflatable bag.

7. The wearable airbag device according to claim 1, characterized in that the at least one inflatable bag is configured to assume alternately a rest configuration when in a deflated status, and an active configuration when in an inflated state;

inflation means being in fluid communication with the at least one inflatable bag and being configured to introduce into the at least one inflatable bag a predetermined quantity of an inflation fluid;

the inflation means being electrically controlled by a control unit suitable for detecting at regular time intervals data detected by sensors arranged on the wearable airbag device.

8. The wearable airbag device according to claim 1, characterized in that the at least one inflatable bag is at least partially coupled to a protector;

the protector being provided with a plurality of through holes at least partially superimposed over the airflow passages of the inflatable bag.

9. The wearable airbag device according to claim 1, characterized in that the at least one inflatable bag is provided with internal tethers.

10. A wearable airbag device comprising at least one inflatable bag including a first side and a second side defining a gas inflatable volume therebetween, characterized in that said at least one inflatable bag comprises a plurality of airflow passages defined between said first side and second side, each passage of the plurality of passages being delimited by internal partitions connecting cut-out portions provided in the first side and in the second side of the inflatable bag.

11. The wearable airbag device according to claim 10, wherein the passages are circular, triangular, square or rectangular shaped.

12. The wearable airbag device according to claim 10, wherein said first side and said second side of the at least one inflatable bag are sewn together or are made of a single weaving operation.

13. The wearable airbag device according to claim 10, further comprising a casing made of breathable material configured to be worn by a user and to house and support said at least one inflatable bag.

14. The wearable airbag device according to claim 10, characterized in that the at least one inflatable bag is configured to assume alternately a rest configuration when in a deflated status, and an active configuration when in an inflated state;

inflation means being in fluid communication with the at least one inflatable bag and being configured to introduce into the at least one inflatable bag a predetermined quantity of an inflation fluid;

the inflation means being electrically controlled by a control unit suitable for detecting at regular time intervals data detected by sensors arranged on the wearable airbag device.

15. The wearable airbag device according to claim 10, characterized in that the at least one inflatable bag is at least partially coupled to a protector;

the protector being provided with a plurality of through holes at least partially superimposed over the airflow passages of the inflatable bag.

16. A wearable airbag device comprising at least one inflatable bag including a first side and a second side defining a gas inflatable volume therebetween, characterized in that said at least one inflatable bag comprises a plurality of airflow passages defined between said first side and second side, said first side and said second side of the at least one inflatable bag being sewn together or made of a single weaving operation, wherein each airflow passage is provided in a non-inflatable area of the inflatable bag, at least one aperture being formed in said non-inflatable area.

17. The wearable airbag device according to claim 16, wherein said non-inflatable area is defined by connecting an internal portion of the first side to a corresponding internal portion of the second side.

18. The wearable airbag device according to claim 16, wherein said non-inflatable area is perimetrically closed and positioned within the inflatable bag.

19. The wearable airbag device according to claim 16, wherein each passage of the plurality of passages is delimited by internal partitions connecting cut-out portions provided in the first side and in the second side of the inflatable bag.

20. The wearable airbag device according to claim 16, wherein the passages are circular, triangular, square or rectangular shaped.

21. The wearable airbag device according to claim 16, further comprising a casing made of breathable material configured to be worn by a user and to house and support said at least one inflatable bag.

22. The wearable airbag device according to claim 16, characterized in that the at least one inflatable bag is configured to assume alternately a rest configuration when in a deflated status, and an active configuration when in an inflated state;

inflation means being in fluid communication with the at least one inflatable bag and being configured to introduce into the at least one inflatable bag a predetermined quantity of an inflation fluid;

the inflation means being electrically controlled by a control unit suitable for detecting at regular time intervals data detected by sensors arranged on the wearable airbag device.

23. The wearable airbag device according to claim 16, characterized in that the at least one inflatable bag is at least partially coupled to a protector;

the protector being provided with a plurality of through holes at least partially superimposed over the airflow passages of the inflatable bag.

* * * * *